United States Patent [19]

Peters

[11] Patent Number: 4,792,729

[45] Date of Patent: Dec. 20, 1988

[54] FLUORESCENT LAMP BRIGHTNESS CONTROL

[75] Inventor: Robert M. Peters, Fort Wayne, Ind.

[73] Assignee: Lyall Electric, Inc., Kendallville, Ind.

[21] Appl. No.: 891,312

[22] Filed: Jul. 31, 1986

[51] Int. Cl.[4] ..... H05B 41/392

[52] U.S. Cl. ..... 315/200 R; 315/209 M; 315/244; 315/DIG. 4; 315/308; 315/219; 315/194

[58] Field of Search ..... 315/291, 209 R, 244, 315/105, DIG. 4, DIG. 2, 284, 194, 308, 307, 219

[56] References Cited

U.S. PATENT DOCUMENTS

| | | | |
|---|---|---|---|
| 4,352,045 | 9/1982 | Widmayer | 315/291 |
| 4,371,812 | 2/1983 | Widmayer | 315/291 |
| 4,388,567 | 6/1983 | Yamazaki et al. | 315/291 |
| 4,447,764 | 5/1984 | Kornrumpf et al. | 315/291 |
| 4,459,515 | 7/1984 | Smith | 315/194 |
| 4,463,286 | 7/1984 | Justice | 315/244 |
| 4,464,610 | 8/1984 | Pitel | 315/291 |
| 4,568,857 | 2/1986 | Head | 315/244 |
| 4,633,141 | 12/1986 | Weber | 315/291 |

*Primary Examiner*—David K. Moore
*Assistant Examiner*—Michael Razavi
*Attorney, Agent, or Firm*—Roger M. Rickert

[57] ABSTRACT

A load side phase control circuit is used in conjunction with a conventional fluorescent light ballast (step-up autotransformer) and an isolation transformer to achieve fluorescent lamp brightness control. A resistor and capacitor connected in series shunt the phase control circuit to maintain low level illumination even when the phase control circuit is nonconducting and also provide a transient suppression when the phase control circuit switches to a conducting state. The circuit is especially suited to printed circuit board preassembly and subsequent connection to the lamp and ballast by a one step crimping operation. The resulting fluorescent lamp system—of the rapid start type—is well suited for use as a task light where the lamp is mounted relatively close to an underlying work area and receives power from a conventional outlet.

13 Claims, 1 Drawing Sheet

FLUORESCENT LAMP BRIGHTNESS CONTROL

SUMMARY OF THE INVENTION

The present invention relates generally to lighting control systems and more particularly to intensity or illumination level control circuits for fluorescent lights. In a particular disclosed preferred embodiment, a phase or duty cycle control is incorporated into a rapid start type fluorescent lamp system having a conventional ballast or autotransformer.

A wide variety of brightness controls are known for electric lighting systems. For incandescent lights, a simple rheostat is a common expedient. Fluorescent lights, while more economical to operate than incandescent lamps, are not readily controlled by this simple expedient. Dimming control arrangements for fluorescent lamps typically employ special and more costly ballasts in conjunction with other circuitry to achieve a range of illumination levels.

Illustrative of such special ballast arrangements in U.S. Pat. No. 4,464,610 where the ballast includes three separate windings for filament heating purposes, two capacitors, and what appear to be a pair of magnetically coupled iron cores. Such a ballast is not standard in the sense of being of a type widely used and produced in such large numbers as to be readily and cheaply available. The truly standard or conventional ballast is formed as an autotransformer on an iron core with a multiply tapped single winding the full extent of which provides the high voltage necessary to initiate lamp operation while the taps comprise the input or primary circuit and two filament (cathode) heating circuits.

A dimmer arrangement for a fluorescent lamp using a standard ballast has been proposed in U.S. Pat. No. 3,935,505. In this patented device, the control circuitry is entirely on the line side of the ballast, that is, the lamp and ballast are interconnected in the conventional manner and the control circuitry is interposed in one of the lines leading from the autotransformer primary winding to the source of line voltage. With this arrangement, filament voltage is lowered as the intensity is diminished placing an undesirably high lower bound on the intensity level as well as causing instability forcing the patentee to employ a negative feedback circuit for compensation. The circuit requires post installation adjustment of a trimmer resistance, and a sequential switch which allows the lamp to heat up before being dimmed. Further, switching noise created by operation of the circuit may be introduced into the voltage supply and thus into other devices connected to the supply. This patented arrangement as well as that of the earlier mentioned U.S. Pat. No. 4,464,610 are sufficiently complex and costly as to preclude their widespread use.

Among the several objects of the present invention may be noted the provision of a simplistic and economical fluorescent lamp dimmer control; the provision of a fluorescent lamp dimmer control employed in a lamp system using a conventional ballast; the provision of a load side phase control circuit for fluorescent lamps utilizing a 1:1 transformer to isolate the phase control circuit from the filament energizing circuit; the provision of an intensity control for a fluorescent lamp used as a task light, receiving power from a conventional outlet and fused at the plug location; the provision of a fluorescent lamp circuit requiring but a single thermal protector associated with a conventional ballast; and the provision of a dimmer control for fluorescent lamps which is readily assembled on a printed circuit board and then connected by a crimp operation to the remainder of the lamp system. These as well as other objects and advantageous features of the present invention will be in part apparent and in part pointed out hereinafter.

In general, a rapid start type fluorescent lamp system includes an elongated fluorescent lamp with low voltage filaments at opposite ends thereof and a step-up autotransformer having a primary circuit and a plurality of secondary circuits, the primary circuit adapted to be energized by line voltage, one secondary circuit for providing a high voltage between lamp ends to initiate lamp operation and thereafter providing an inductive impedance limiting lamp current, a second secondary circuit for energizing one of the low voltage filaments, and a third secondary circuit for energizing the other low voltage filament. A phase control circuit connects the lamp to said one secondary circuit for selectively controlling lamp current and, therefor, also controlling lamp intensity, and a transformer provides isolation for coupling the second secondary circuit and the one low voltage filament without shunting the phase control circuit.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
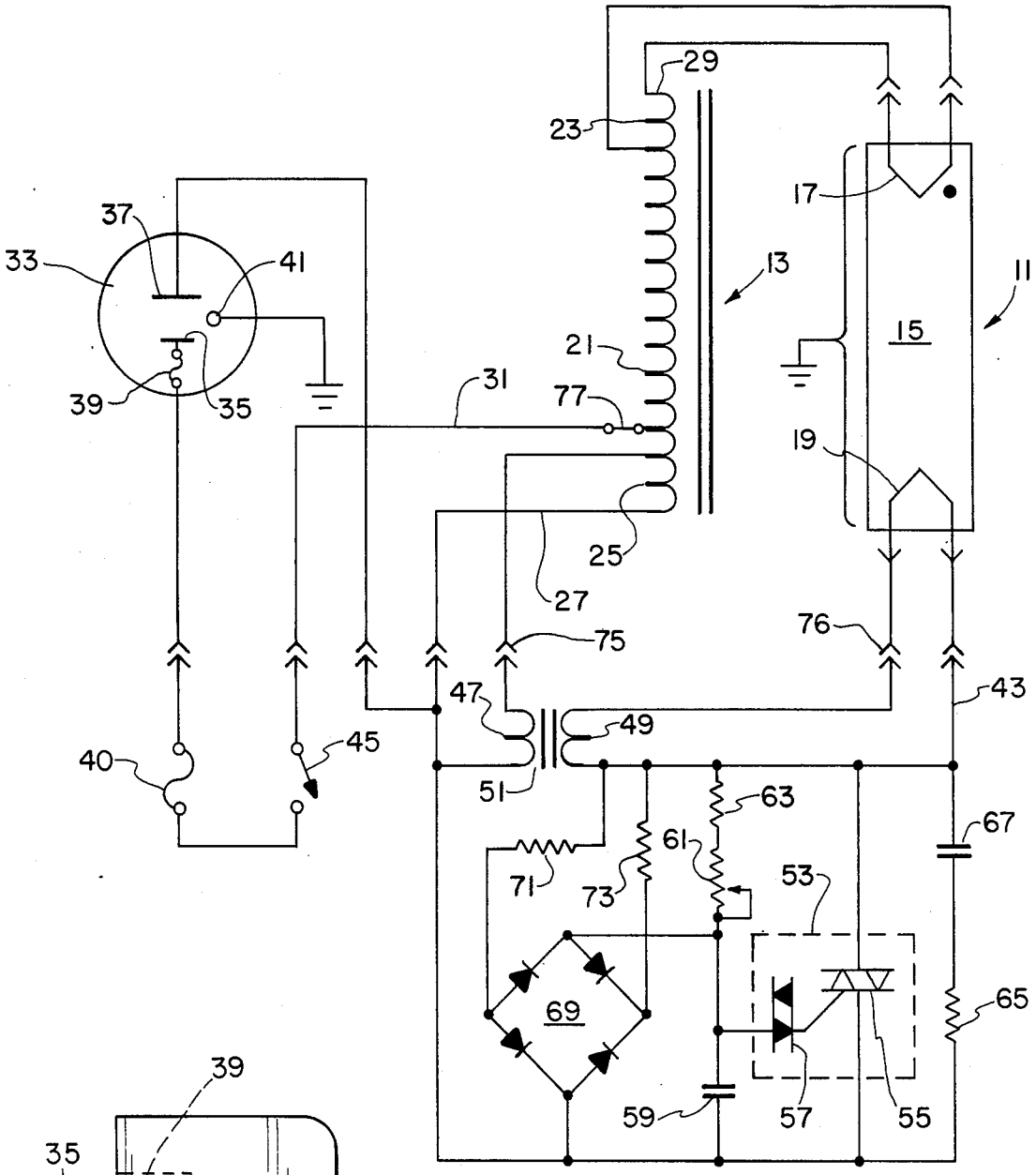
FIG. 1 is a schematic diagram of a rapid start type fluorescent lamp system utilizing a conventional ballast and illustrating the invention in one form.
Figure 2:
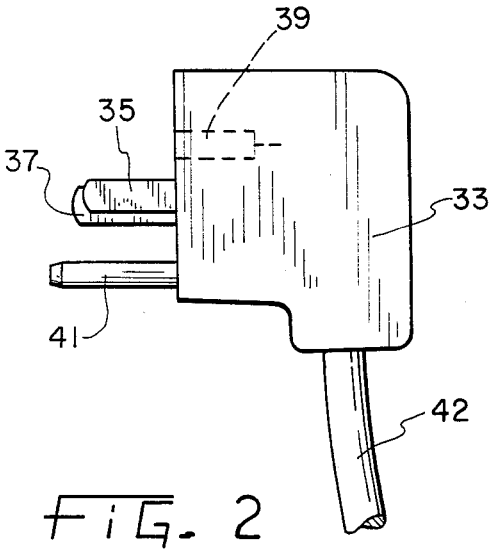
FIG. 2 is a side elevation view of a fused plug for connecting a task light embodiment of the invention to a conventional outlet.

In FIG. 1 there is illustrated a rapid start (continuously heated cathode) type fluorescent lamp system having an elongated fluorescent lamp 11 with low voltage filaments 17 and 19 at opposite ends thereof and a step-up autotransformer or ballast 13 having a single multiply tapped winding 21 including a primary circuit between leads 27 and 31, and a plurality of secondary circuits. The primary circuit is adapted to be energized by line voltage by way of closed switch 45 from plug 33 while one secondary circuit across the extreme ends of winding 21 between lines 27 and 29 is for providing a high voltage between lamp ends to initiate lamp operation and thereafter providing an inductive impedance limiting lamp current. A second secondary circuit including winding segment 25 is for energizing one of the low voltage filaments 19, and a third secondary circuit including winding segment 23 is for energizing the other low voltage filament 17. A phase control circuit including the solid state switching device 53 connects the lamp to the one secondary circuit for selectively controlling lamp current and, therefor, also controlling lamp intensity. Transformer 51 provides isolation for coupling the second secondary circuit 25 and the one low voltage filament 19 without shunting the phase control circuit.

The circuit of FIG. 1 has particular, but not exclusive, utility when the lamp is employed as a task light where the fluorescent lamp 11 is mounted relatively close to an underlying work area as described more completely, for example, in U.S. Pat. No. 4,562,515 and the system receives power from a conventional outlet. The system includes a plug 33 having blades 35 and 37 along with ground prong 41 which are mateable with a conventional outlet and connected to supply power to the primary circuit between lines 27 and 31. The plug includes a replaceable plug-in fuse 39 for current overload protection. This particular positioning of fuse 39 affords maximum current overload protection for the illustrated circuitry. When compared to (optional) fuse 40 for example, a short in line cord 42 will trip fuse 39, but would fail to trip fuse 40.

When line voltage, say 115 volts, is applied to the primary circuit as by closing the on-off switch 45, a voltage step-up action occurs so that the voltage across the complete winding 21 is around 300 volts. This high voltage is impressed across the region 15 of lamp 11 to initiate conduction through and illumination of the lamp. Once conduction is established, the voltage drop between the cathodes 17 and 19 drops markedly and current limiting is provided by the inductive effect of winding 21. This description of the start up action assumes that the high voltage is actually applied across the cathodes 17 and 19 of the lamp as will be the case if the phase control circuit is conducting as, for example, when variable resistor 61 is set at its minimum value or if lines 43 and 27 were to be directly connected together effectively removing the phase control circuit from the system.

The phase control circuit comprises a bilateral solid state gate controlled switching device such as triac 55 connected in series between the lamp and the one (high voltage) secondary circuit, and a relaxation oscillator including resistor 63, variable resistor 61 and capacitor 59 connected in controlling relation to the gate of the switching device by a threshold device such as an A-C switching diode or diac 57.

Ballast 13 includes a thermal protection device 77, for example, a bimetalic disk, which is located in close proximity to and in good heat transfer relationship with the winding 21 so as to be actuated to open the power supply line 31 in the event of overheating of the ballast. The transformer 51 is a low voltage (about 6 volts) 1:1 transformer having about the same number of turns in the primary winding 47 and in the secondary winding 49. The transformer operates at a very low current level, for example, a 350 milliampere rating, and requires no such thermal protection, hence, the thermal protector 77 is the only thermal protection device in the system.

All of the components below the horizontal line of crimp connectors such as 75 and 76 in FIG. 1 are permanently connected to a common printed circuit board including the isolating transformer 51, on-off switch 45, fuse 40 if present as well as the phase control and related components, and that board has seven leads extending therefrom to be crimp connected to the upper part of the circuit including to the lamp as by crimp connector 76 and to the ballast or autotransformer as by crimp connector 75. Advantageously, these crimp connections are accomplished using the MTA system available from Amp, Inc. which employs a simultaneous insulation piercing or displacing and crimping for each connection.

Figure 3:
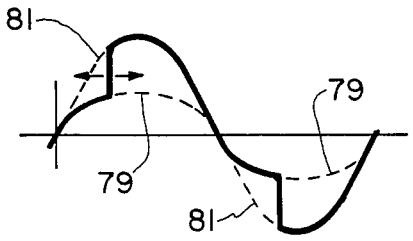
FIG. 3 is a simplified one cycle depiction of lamp current illustrating the effect of the control circuit.

Included on the printed circuit board are a resistor 65 and capacitor 67 connected in series between the lamp 11 and secondary high voltage winding of leads 27 and 29. This series resistor and capacitor are connected in parallel with the phase control circuit effectively bypassing switching device 53 when that device is nonconducting and supplying a low level energization current to the lamp 11. The series circuit also suppresses voltage surges when the phase control circuit is switched to a conducting state and provides an impedance which tends to prevent overvoltages across the triac 55. This low level current is illustrated by the dotted sine wave 79 in FIG. 3. If the switching device were to be conductive at all times, the lamp current would be as illustrated by sine wave 81 in FIG. 3. In actual operation, the lamp current follows the solid line in FIG. 3 with the nearly vertical jump in current occurring when the switch 53 is gated to its conducting state. The time in each cycle (earlier or later as indicated by the arrows) where this jump occurs, and thus the energy supplied to the lamp and resulting intensity level is controlled by the setting of potentiometer 61 which determines the charging rate for capacitor 59. Each time diac 57 conducts to discharge capacitor 59 through the gate of triac 55, the diode bridge circuit 69 and matched pair of resistors 71 and 73 thereafter function to reset the initial capacitor charge to the same level thereby. eliminating any hysteresis effect and ensuring a balanced current flow, i.e., symmetry of the two half cycles illustrated in FIG. 3. There would actually be a phase difference between the sine waves 79 and 81 due to the presence of capacitor 67, but this has little effect on the operation of the system and has been ignored for the purposes of explaination.

One implementation of the invention which has been built and tested successfully employed the following illustrative circuit components. Resistors 71 and 73 were both 15,000 ohms. Variable resistor 61 was 500,000 ohms. Resistor 63 was 6800 ohms. Capacitors 59 and 67 were 0.02 and 0.10 microfarads respectively. Resistor 65 was 100 ohms. Diac 57 and triac 55 were purchased as a single component 53 called a quadrac, Teccor model number Q6004FT1.

From the foregoing, it is now apparent that a novel arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A rapid start type fluorescent lamp system comprising:

an elongated fluorescent lamp with low voltage filaments at opposite ends thereof;

a step-up autotransformer having a primary circuit and a plurality of secondary circuits, the primary circuit adapted to be energized by line voltage, one secondary circuit for providing a high voltage between lamp ends to initiate lamp operation and thereafter providing an inductive impedance limiting lamp current, a second secondary circuit for energizing one of the low voltage filaments, and a third secondary circuit for energizing the other low voltage filament;

a thermal protection device responsive to autotransformer temperature for opening the primary circuit when the autotransformer temperature exceeds a predetermined value;

a phase control circuit comprises a bilateral solid state gate controlled switching device connecting the lamp to said one secondary circuit for selectively controlling lamp current and, therefore, also controlling lamp intensity and a relaxation oscillator connected in controlling relation to the gate of the switching device;

isolating means comprises a transformer having a Primary winding and a secondary winding with a 1:1 winding turns ratio for coupling the second secondary circuit and the one low voltage filament without shunting the phase control circuit;

a printed circuit board having a plurality of leads extending therefrom to be crimp connected to other leads in the lamp system including at least leads to the lamp and leads to the autotransformer; and an on-off switch to be connected in series with the primary circuit, the phase control circuit, on-off switch, and isolating means being permanently connected to the printed circuit board.

2. The lamp system of claim 1 wherein the third secondary circuit is directly connected to the other low voltage filament.

3. The lamp system of claim 1 wherein the isolating means comprises a transformer.

4. The lamp system of claim 1 wherein there is only one thermal protection device in the system.

5. The lamp system of claim 1 further comprising a resistor and a capacitor connected in parallel with the phase control circuit and in series between the lamp and secondary circuit for providing low level lamp current when the phase control circuit is blocking lamp current and suppressing voltage surges when the phase control circuit is switched to a conducting state.

6. The lamp system of claim 2 wherein the relaxation oscillator comprises a variable resistor in series with a capacitor, and a threshold device responsive to capacitor voltage to discharge the capacitor through the switching device gate when the capacitor voltage exceeds a prescribed value.

7. The lamp system of claim 6 wherein the variable resistor controls the capacitor charging rate and, therefor determines the lamp intensity.

8. The lamp system of claim 1 for use as a task light where the fluorescent lamp is mounted relatively close to an underlying work area and the system receives power from a conventional outlet, the system including a plug mateable with a conventional outlet and connected to supply power to the primary circuit, the plug including a fuse for current overload protection.

9. In a fluorescent lamp system having a conventional autotransformer with a primary circuit, a high voltage secondary circuit, and two low voltage secondary circuits for energizing lamp filaments, isolating means for energizing the filaments without applying the high voltage to the lamp comprising a transformer having a primary winding and a secondary winding with a 1:1 winding turns ratio having one winding thereof directly connected to one of the low voltage secondary circuits and the other winding thereof directly connected to one lamp filament, a phase control circuit comprises a bilateral solid state gate controlled switching device connected in series between the lamp and the one secondary circuit interconnecting the windings of the one-to-one transformer for controlling the high voltage applied to the lamp, and a relaxation oscillator connected in controlling relation to the gate of the switching device and a resistor and a capacitor connected in parallel with the phase control circuit and in series between the lamp and high voltage secondary circuit for providing low level lamp current when the phase control circuit is blocking lamp current and suppressing voltage surges when the phase control circuit is switched to a conducting state.

10. The lamp system of claim 9 wherein the other lamp filament and other low voltage secondary circuit are directly connected together.

11. The lamp system of claim 9 further comprising a printed circuit board and an on-off switch to be connected in series with the primary circuit, the phase control circuit, resistor, capacitor, on-off switch, and isolating means being permanently connected to the printed circuit board.

12. The lamp system of claim 11 wherein the printed circuit board has a plurality of leads extending therefrom to be crimp connected to other leads in the lamp system including at least leads to the lamp and leads to the autotransformer.

13. The lamp system of claim 9 for use as a task light where the fluorescent lamp is mounted relatively close to an underlying work area and the system receives power from a conventional outlet, the system including a plug mateable with a conventional outlet and connected to supply power to the primary circuit, the plug including a fuse for current overload protection.

* * * * *